US008196250B2

(12) United States Patent
Kawka

(10) Patent No.: US 8,196,250 B2
(45) Date of Patent: Jun. 12, 2012

(54) APPARATUS FOR CLEANING THE HEAD OF A GOLF CLUB

(76) Inventor: Richard Dean Kawka, Powder Springs, GA (US)

( * ) Notice: Subject to any disclaimer, the term of this patent is extended or adjusted under 35 U.S.C. 154(b) by 623 days.

(21) Appl. No.: 12/393,028

(22) Filed: Feb. 25, 2009

(65) Prior Publication Data

US 2009/0211046 A1 Aug. 27, 2009

Related U.S. Application Data

(60) Provisional application No. 61/066,928, filed on Feb. 25, 2008.

(51) Int. Cl.
*A46B 11/00* (2006.01)
*A63B 57/00* (2006.01)
*A63B 47/04* (2006.01)

(52) U.S. Cl. ..... 15/160; 15/21.2; 15/210.1

(58) Field of Classification Search ..... 15/184, 15/112, 161; 206/315.3; *A47L 23/22*
See application file for complete search history.

(56) References Cited

U.S. PATENT DOCUMENTS

| | | | | |
|---|---|---|---|---|
| 2,744,276 | A | | 5/1956 | Chambless |
| 2,871,499 | A | | 2/1959 | Gardner |
| 3,583,018 | A | | 6/1971 | Fink |
| 4,069,536 | A | | 1/1978 | Hartz et al. |
| 4,380,839 | A | | 4/1983 | Caradonna |
| 4,384,384 | A | | 5/1983 | Trojohn |
| 4,734,952 | A | | 4/1988 | Parchment |
| 4,821,358 | A | | 4/1989 | Wyckoff et al. |
| 4,965,906 | A | | 10/1990 | Mauro |
| 5,081,735 | A | | 1/1992 | Wyatt et al. |
| 5,155,883 | A | | 10/1992 | Legault |
| 5,269,615 | A | | 12/1993 | Lewis, Jr. |
| 5,404,610 | A | | 4/1995 | Coyer et al. |
| 5,511,274 | A | | 4/1996 | Lewis, Jr. |
| 5,533,225 | A | * | 7/1996 | Ellis ..... 15/104.92 |
| 5,555,589 | A | | 9/1996 | Moultrie |
| 5,572,761 | A | | 11/1996 | Meyer |
| 5,597,212 | A | | 1/1997 | Lewis, Jr. |
| 5,666,684 | A | | 9/1997 | Cussen |
| 5,732,435 | A | | 3/1998 | Williams et al. |
| 5,819,355 | A | | 10/1998 | Wu |
| 5,878,460 | A | * | 3/1999 | Bruce ..... 15/160 |
| 5,970,561 | A | * | 10/1999 | Archibeque ..... 15/161 |
| 5,983,432 | A | | 11/1999 | Jones |
| 6,213,891 | B1 | | 4/2001 | Moore |
| 6,317,916 | B1 | | 11/2001 | Smith |
| 6,422,641 | B1 | | 7/2002 | Coryell |
| 6,733,016 | B2 | | 5/2004 | Chung |

(Continued)

*Primary Examiner* — Monica Carter
*Assistant Examiner* — Stephanie Newton
(74) *Attorney, Agent, or Firm* — Michael V. Drew

(57) ABSTRACT

An apparatus for cleaning heads of golf clubs has a substantially upstanding housing having an upper end, a lower end and a wall structure interconnecting the two and defining a chamber. At least one portal is formed in the wall structure. The portals may be slot-like or may have a curvilinear configuration such as a circle or ellipse. A set of brushes extends from the interior of the upper end into the chamber. An opposing set of brushes extends from the interior of the lower end into the chamber. The terminal ends of the two sets of brushes define a substantially narrow passageway in alignment with the portals. At least one of the upper and lower sets of brushes has a plurality of bristle zones wherein the brush bristles of one bristle zone are of a different length and rigidity than the brush bristles of a different bristle zone.

20 Claims, 6 Drawing Sheets

U.S. PATENT DOCUMENTS 6,745,424 B1 6/2004 Pimentel et al.
6,786,835 B1 9/2004 Carter
6,938,296 B1 9/2005 Scheuermann
7,121,954 B2 10/2006 Charron
7,162,766 B1 1/2007 Yakopcic
7,261,652 B2 8/2007 Gold
7,356,868 B1 4/2008 Herrmann

* cited by examiner

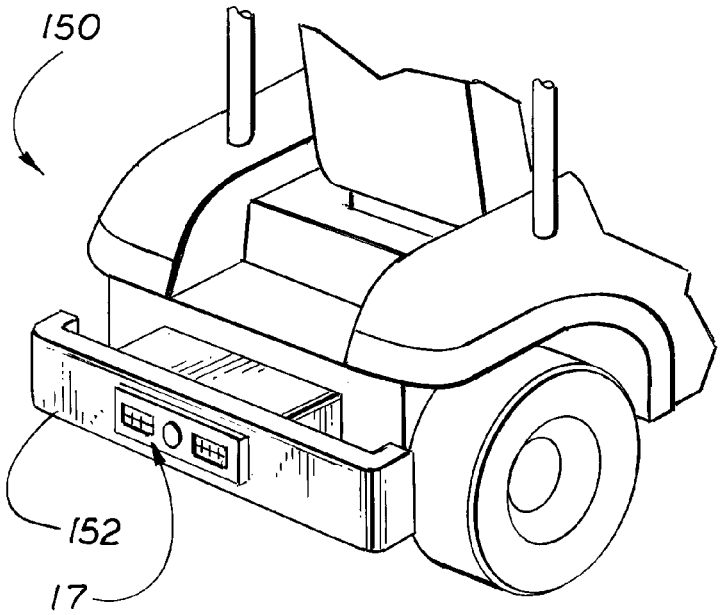
Fig_15
Fig_14
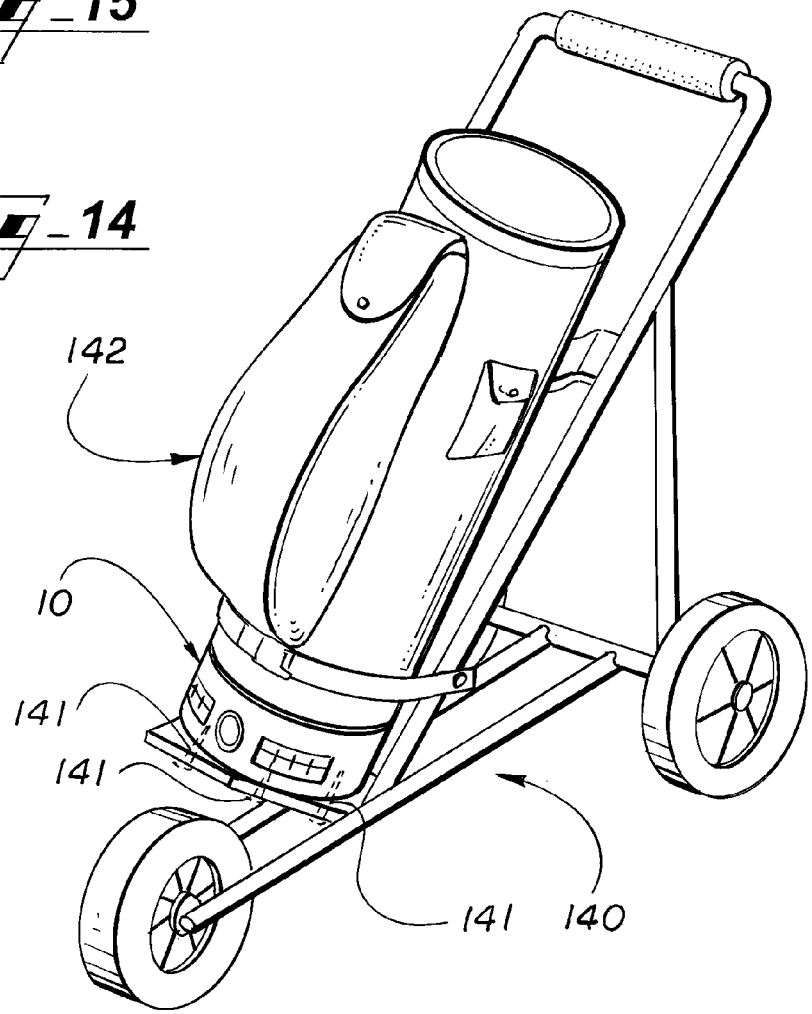

APPARATUS FOR CLEANING THE HEAD OF A GOLF CLUB

RELATED APPLICATIONS

This application claims priority to U.S. Provisional Application No. 61/066,928 filed Feb. 25, 2008, the entirety of which is incorporated herein by reference.

TECHNICAL FIELD

This invention relates to an apparatus for cleaning the heads of golf clubs, and more particularly, the invention relates to an apparatus for cleaning the heads of golf clubs, which apparatus is conveniently accessible to a user.

BACKGROUND OF THE INVENTION

In the game of golf, when a player hits a golf ball it is customary, and considered to be good practice, for the head of the club to at least partially skim the ground under the ball. When the surface under the ball is skimmed in this manner debris such as grass and dirt are deposited upon the head of the golf club. However, in order to hit a ball in an optimum manner it is important that the head of a club be as clean as possible. Therefore, after hitting a shot it is necessary to remove any debris that has been deposited upon the head of a golf club.

There are several important factors that must be taken into consideration in order to clean debris from the head of a golf club. One important factor is that the debris should be cleaned soon after it is deposited so that moist grass or dirt will not dry out and thereby become more difficult to remove. Another factor is that it is desirable to remove debris before the club is placed in a receptacle where the debris might fall and collect.

Still another factor is that golfers and the operators of golf courses both desire that the club head be cleaned as quickly as possible so that the golfer can quickly move along the golf course. Quickness of play is particularly important to operators of a golf course because a key principle in the operation of a golf course is to move players along as quickly as possible. The number of individuals or groups of individuals that can play on a golf course during a given period of time (such as an hour or a day) is directly proportional to how quickly a player or group of players move along the course and thereby make way for the following players or group of players. When play is speeded up the use (and profitability) of the golf course is increased.

Thus, it can be appreciated that there is a need to have a means for golfers to quickly and conveniently clean the heads of golf clubs used during play on a golf course.

SUMMARY OF THE INVENTION

An apparatus for cleaning heads of golf clubs, according to the invention, comprises a substantially upstanding housing having an upper end, a lower end and a wall structure interconnecting the upper end and lower end defining a chamber. At least one portal is formed in the wall structure. The portals may be slot-like or may have a curvilinear configuration such as a circle or ellipse. A set of brushes extends from the interior of the upper end into the chamber. And an opposing set of brushes extends from the interior of the lower end into the chamber. The terminal ends of the two opposing sets of brushes define a substantially narrow passageway in alignment with the portal or portals.

In accordance with one aspect of the invention, at least one of the upper set of brushes and the lower set of brushes has a plurality of bristle zones wherein the brush bristles of one bristle zone are of a different length and rigidity than the brush bristles of a different bristle zone. One bristle zone has long, soft bristles for cleaning the rear surface of a club head that may be soiled only incidentally. Another bristle zone has bristles of a medium length, in comparison to the long, soft bristles, for general cleaning of the face of a golf club head and also aggressive cleaning of the face of a golf club head inserted through the central portal. An additional bristle zone has bristles of a short length, in comparison to the long, soft bristles and the medium-length bristles, for aggressive cleaning of the face of a club head. Although there are at least five identifiable zones by location there are only three distinct characteristic bristles. Thus some of the location zones have the same types of characteristic bristles.

In accordance with a further aspect of the invention, at least one portal has a set of brush bristles extending inwardly from an inner periphery of the portal. The terminal ends of the brush bristles define an opening.

In accordance with another aspect of the invention, at least one of the portals is covered by a flexible curtain.

In accordance with a methodology taught by the invention, a narrow club head is inserted through a slot-like portal in a predetermined face-upward or face-downward condition and the face of the club is aggressively rubbed over selected brush bristles. And a bulbous club head is inserted through a curvilinear portal in a predetermined face-upward or face-downward condition and the face of the club is aggressively rubbed over selected bristles.

BRIEF DESCRIPTION OF THE DRAWINGS

FIG. 14 is an illustration of an apparatus for cleaning the heads of golf clubs attached to a push/pull-type golf club cart in accordance with an embodiment of the invention.

FIG. 15 is an illustration of an apparatus for cleaning the heads of golf clubs used in conjunction with a riding-type golf cart in accordance with an embodiment of the invention.

DETAILED DESCRIPTION

Figure 1:
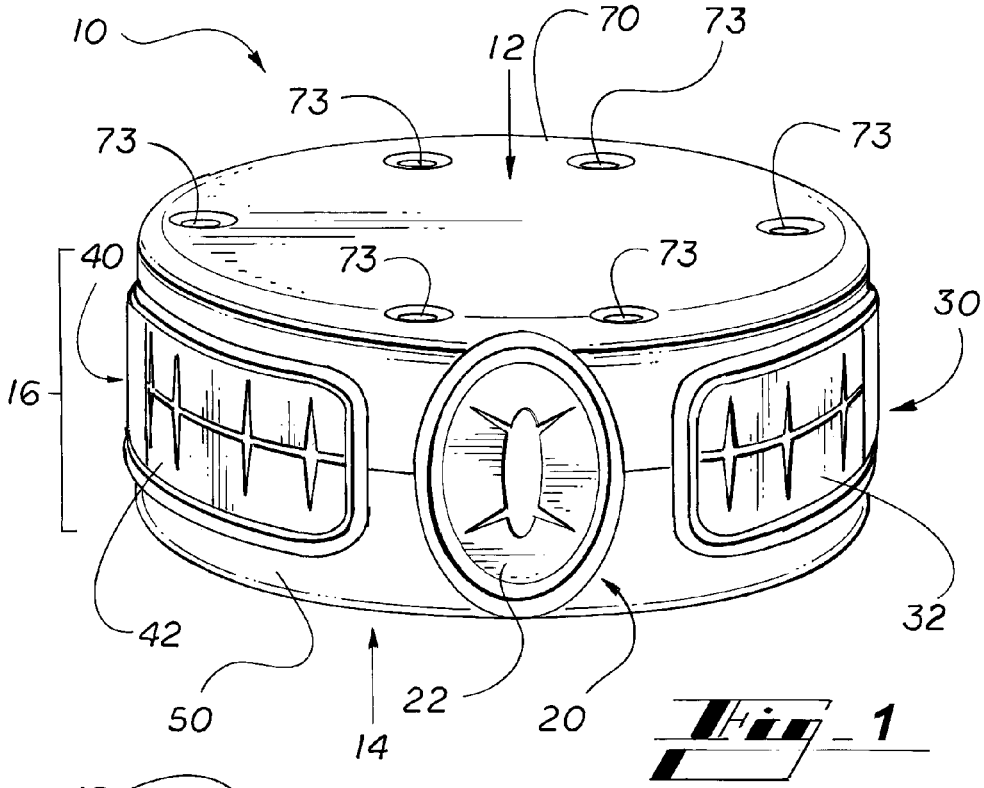
FIG. 1 is a perspective view of an apparatus for cleaning the heads of golf clubs in accordance with an embodiment of the invention.

Detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments.

As an overview, the invention provides a housing forming an enclosed chamber. The housing has curtained portals through which the heads of golf clubs are inserted. The interior of the chamber has opposing upper and lower sets of brushes for cleaning the front and back surfaces of the head of a golf club. At least one portal is designed to receive the flattened head of a standard golf club, which is typically referred to as an "iron," and at least one portal is designed to receive the somewhat bulbous-type head of a wood or hybrid club. The curtain may be formed of resilient flaps. A portal, particularly the portal for woods and hybrids, may have a set of portal brushes in a periphery of the portal opening behind the portal curtain. The sets of brushes in the chamber may have zones. The different zones have brush bristles of different lengths and rigidities to provide different cleaning actions. The chamber may be a stand-alone apparatus that can be attached to preexisting articles such as a golf bag or golf cart. The housing may also be incorporated as a part of an integrated apparatus for storing, transporting and cleaning the heads of golf clubs.

Referring first to FIG. 1, therein is illustrated an apparatus for cleaning the heads of golf clubs 10 in accordance with an embodiment of the invention. A substantially upstanding housing has an upper end 12 and a lower end 14 interconnected by a wall structure 16. One or more portals 20, 30, 40 into the chamber are formed in the wall structure 16. Each portal 20, 30, 40 may have a curtain 22, 32, 42 that may be formed of flaps, and in particular, opposing flaps that define an entranceway. The housing may be formed of a lower subassembly 50 and an upper subassembly 70. The hollow bases of upper posts 73 that are disposed in the interior of the upper chamber 70 are shown.

Figure 2:
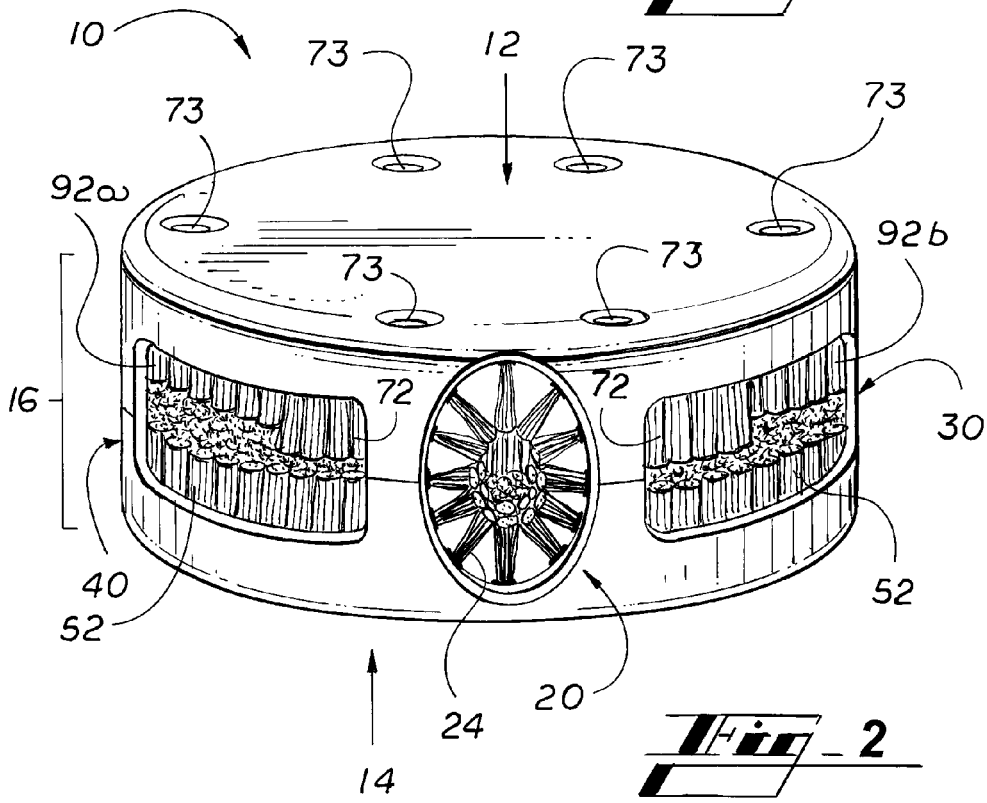
FIG. 2 is a perspective view of the apparatus of FIG. 1 with curtain flaps removed from portals.

Referring now to FIG. 2, therein is illustrated the apparatus of FIG. 1 with the portal curtains 22, 32, 42 removed. The lower subassembly 50 and upper subassembly 70 are shown. A brush set 24 is shown depending from the inner periphery of the center portal 20. The portals may have a curvilinear configuration, such as the central portal 20, or the portals may be slot-like, such as the flanking portals 30, 40. The curvilinear configuration accommodates the bulbous heads of woods or hybrid clubs. Examples of curvilinear configurations are elliptical and circular. In the embodiment illustrated, the central portal 20 is substantially elliptical. Portion of features seen through the portals 20, 30, 40, which features will be described in greater detail later, include first bristle zone 52, third bristle zone 72, and fifth bristle zone 92*a*, 92*b*.

Figure 3:
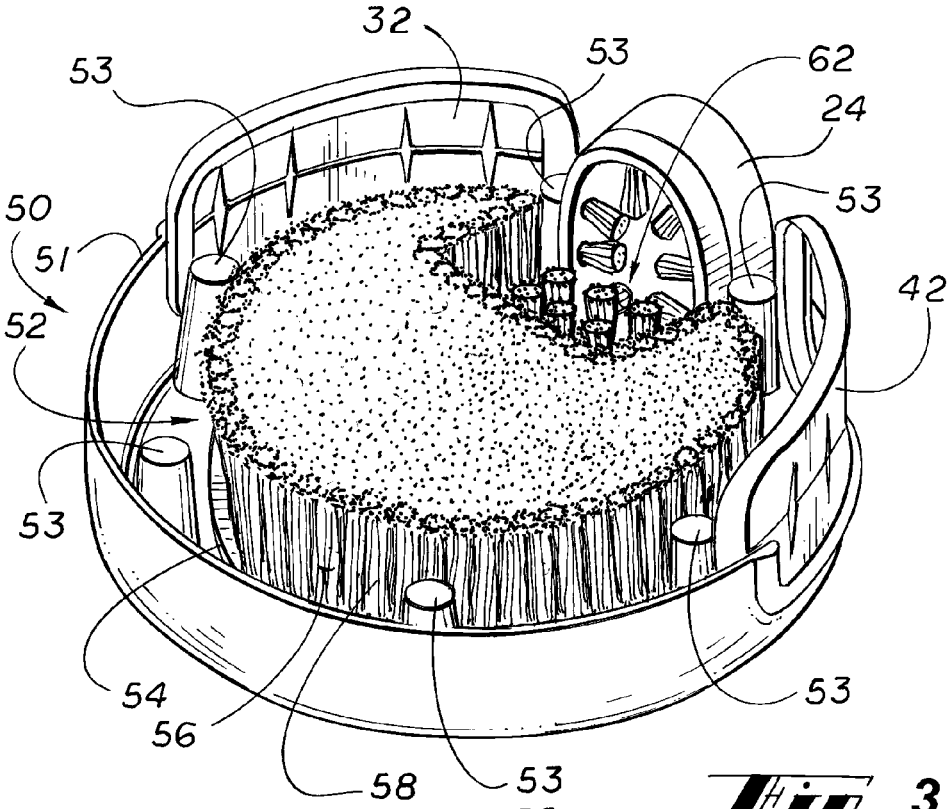
FIG. 3 is a perspective view of the interior of a lower subassembly for the apparatus of FIG. 1.

Referring now to FIG. 3, therein is illustrated the interior of a lower subassembly 50 according to an embodiment of the invention. Also shown are portal inserts including central-portal brush set 24 and flanking portals curtains 32, 42. An upstanding lower wall 51 forms a portion of the housing wall structure 16. Lower posts 53 are disposed for joining the lower subassembly 50 to the upper subassembly 70 (not shown in the view of FIG. 3). A lower brush set extends into the chamber. Although the lower brush set may be uniform, the invention teaches a multiple-bristle-zone brush set. The zones described herein are distinguished by location and type of bristle used in the particular zone. Although bristles of many types may be used, the invention the embodiment illustrated and described uses three types of bristles. The three types of bristles may be used in more than one zone location. A first bristle zone 52 is disposed substantially throughout a major region of the lower subassembly 50. The first bristle zone 52 has a first brush pad 54 as a foundation from which first tufts 56 of first brush bristles 58 extend. A second bristle zone 62 is disposed adjacent the central portal and central-portal brush set 24. The second bristle zone 62 has a second brush pad 64 as a foundation from which second tufts 66 of second brush bristles 68 extend.

Figure 4:
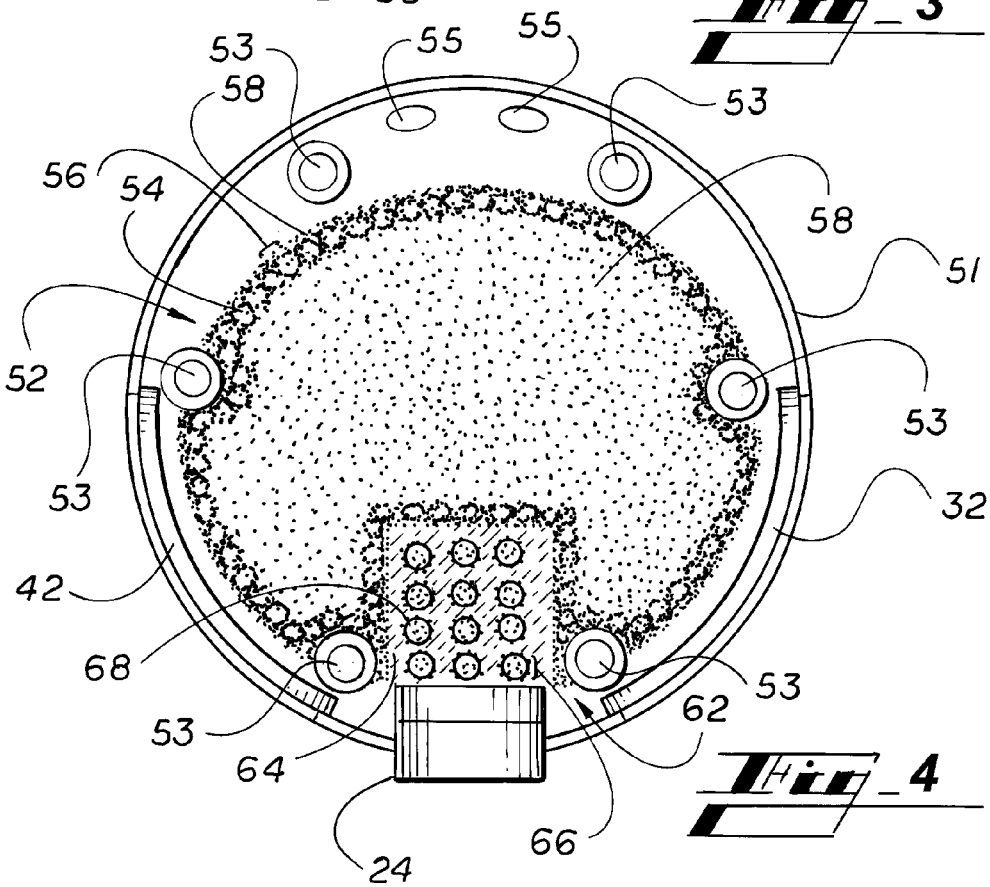
FIG. 4 is a plan view of the interior of the lower subassembly of FIG. 3.

Referring now to FIG. 4, therein is illustrated a plan view of the lower subassembly 50. The features described with respect to FIG. 3 are illustrated from a plan-view vantage point in FIG. 4. The central-portal brush set 24 is flanked by portal curtains 32, 42. The lower wall 51 defines the perimeter of the lower subassembly 50. The lower posts 53 are spaced apart around a region proximate a periphery of the lower wall 51. Debris ports 55 are apertures disposed in the lower subassembly 50 to facilitate removal of debris collected in the chamber. The configuration and locations of the first bristle zone 52 and second bristle zone 62 are also shown in the plan view.

Figure 5:
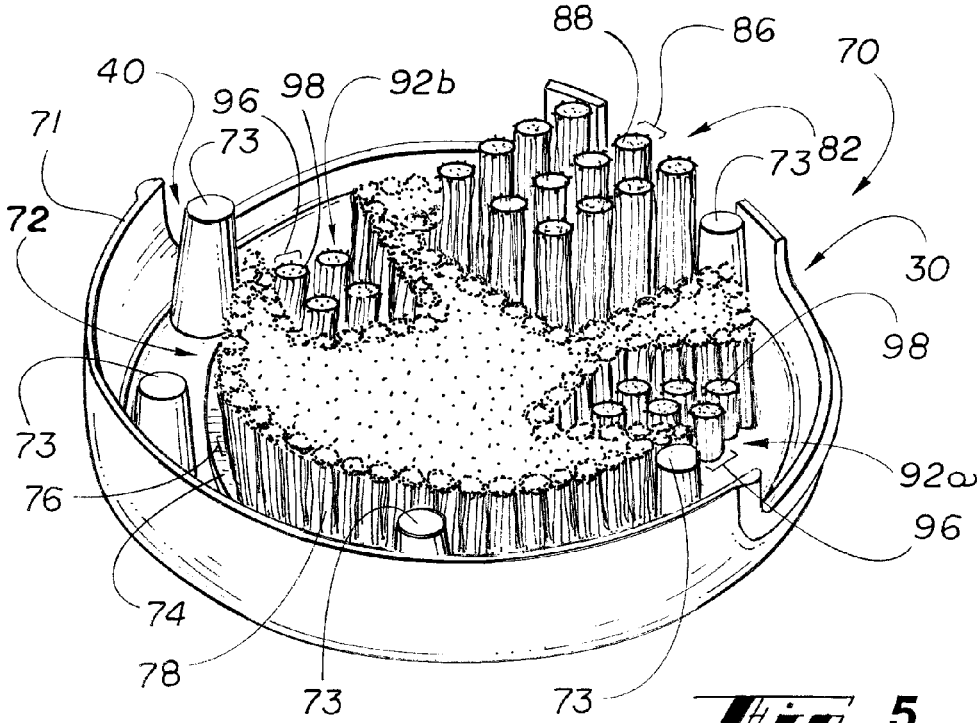
FIG. 5 is a perspective view of the interior of an upper subassembly for the apparatus of FIG. 1.

Referring now to FIG. 5, therein is shown the interior of an upper subassembly 70 according to an embodiment of the invention. An upstanding upper wall 51 (although oriented downwardly in the assembled housing) forms an upper portion of the housing wall structure 16. Upper posts 73 are disposed for alignment with the lower posts 53 (not shown in this view) for joining the upper subassembly 50 to the lower subassembly 50 (not shown in the view of FIG. 5). An upper brush set extends into the chamber. Although the upper brush set may be uniform, the invention teaches a multiple-zone brush set. A third bristle zone 72 is disposed substantially throughout a major region of the upper subassembly 70. The third bristle zone 72 has a third brush pad 74 as a foundation from which third tufts 76 of third brush bristles 78 extend. A fourth bristle zone 82 is disposed adjacent the central portal and central-portal brush set (not shown in the view of FIG. 5). The fourth bristle zone 82 has a fourth brush pad 84 as a foundation from which fourth tufts 86 of fourth brush bristles 88 extend. A fifth bristle zone 92 is disposed adjacent each flanking portal 30, 40. The fifth bristle zone 92 has a fifth brush pad 94 as a foundation from which fifth tufts 96 of fifth brush bristles 98 extend. The fifth bristle zone 92 is designated as a distinct zone of specified bristles based upon its location adjacent the flanking portals 30, 40. For convenience of explanation, the alphabetical suffixes "a" and "b" have been used to distinguish between the fifth bristle zone 92*a* that is disposed adjacent the flanking portal designated by numeral "30" and the fifth bristle zone 92*b* that is disposed adjacent the portal designated by the numeral "40."

Figure 6:
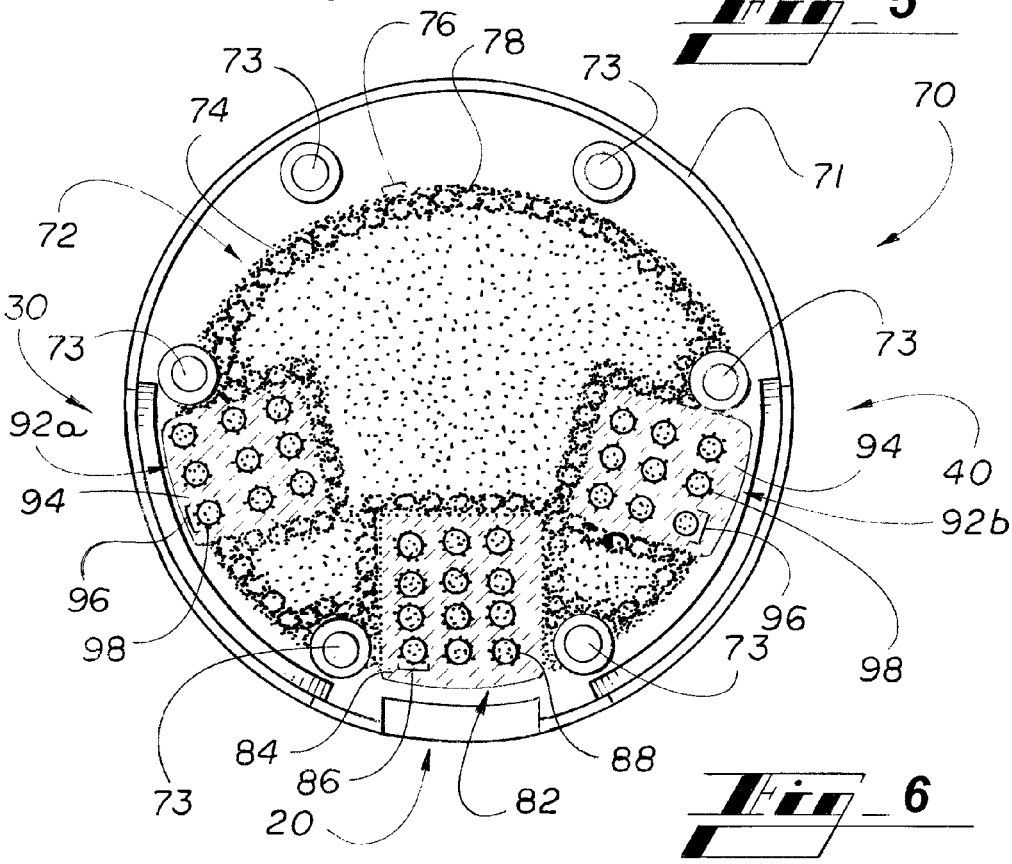
FIG. 6 is a plan view of the interior of the upper subassembly of FIG. 5.

Referring now to FIG. 6, therein is illustrated a plan view of the upper subassembly 70. The features described with respect to FIG. 5 are illustrated from a plan-view vantage point in FIG. 6. The upper wall 71 defines the perimeter of the upper subassembly 70. The upper posts 73 are spaced apart around a region proximate a periphery of the upper wall 71 for alignment with the lower posts 53 (not shown in this view). The configuration and locations of the third bristle zone 72, fourth bristle zone 82, and fifth bristle zone 92 are also shown in the plan view.

Figure 7:
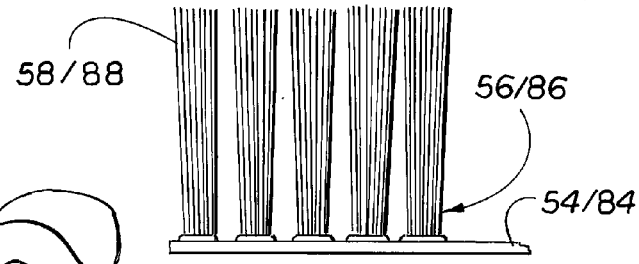
FIG. 7 is an elevation illustration of representative brush pad, tufts and bristles of the apparatus of FIG. 1 wherein the brush bristles are a first length and rigidity.
Figure 8:
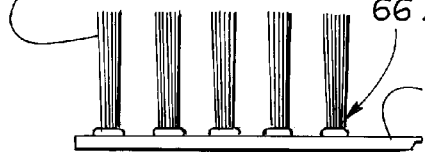
FIG. 8 is an elevation illustration of representative brush pad, tufts and bristles of the apparatus of FIG. 1 wherein the brush bristles are of a second length and rigidity.
Figure 9:
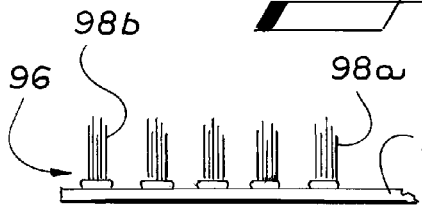
FIG. 9 is an elevation illustration of representative brush pad, tufts and bristles of the apparatus of FIG. 1 wherein the brush bristles are of a third length and rigidity.

Reference is now made generally to FIGS. 7, 8 and 9. The set of brushes in the lower subassembly 50 (lower set of brushes) and set of brushes in the upper assembly 70 (upper set of brushes) are disposed for effectively cleaning the faces of club heads. Although all of the brush bristles of the lower set may be uniform and/or all of the brush bristles of the upper set may be uniform, the bristles of each set are divided into at least two zones by location each zone having bristles of different characteristics. The bristles have different characteristics relating to length and rigidity. Rigidity typically is a function of the type of material from which the bristle is constructed, the diameter or thickness of the bristle and, to a certain extent, the length of the bristle. In the embodiment illustrated, there are two bristle zones 52, 62 in the lower subassembly 50 and three bristle zones 72, 82, 92 in the upper subassembly 70.

The bristles of each zone are designed to carry out a specified club-head cleaning function. There is a relative relationship among the types of bristles used in the zones. There are three types (or characteristics) of bristles, namely, long, soft bristles; medium-length bristles; and short, substantially rigid bristles. Although a single or more than three types of bristles may be used, the invention utilizes three types/characteristics of bristles. There are six total bristle zones by location in the embodiment of the invention described herein. However, there are only three characteristic types of bristles. Two of the zones in the lower set of brushes use the same bristles as two of the zones in the upper set of brushes.

The long, soft bristles are disposed and used to lightly clean areas of club heads that do not directly engage debris but that may only become incidentally soiled through club use. An example of such an area is the rear surface of a club head. The medium bristles are disposed and used for generally cleaning a club face and also for aggressively cleaning a club face that is inserted through the central portal 20. The short bristles are disposed and used for more aggressive cleaning of a club face that is inserted through the slot-like portals 30, 40.

As illustrated in FIG. 7, the bristles 58 of the first zone 52 and the bristles 88 of the fifth zone 82 are long, soft bristles. The long, soft bristles 52 of the first zone 52 are disposed in the lower subassembly 50 for cleaning the rear surface of a typical, substantially flat golf club head that is inserted in an upward-facing orientation through either slot-like portal 30 or 40 that flanks the central portal 20. The long, soft bristles 88 of the fifth zone are disposed in the upper subassembly 70 proximate the central portal 20 for cleaning the rear surface of a bulbous-headed wood or hybrid golf club that is inserted face-down in the central portal 20.

As illustrated in FIG. 8, the bristles 68 of the second zone 62 and the bristles of the 78 of the third zone 72 are bristles of medium length in comparison to the length of the long bristles of FIG. 7. The medium bristles 68 of the second zone 62 are disposed in the lower subassembly 50 adjacent the central portal 20 for cleaning a downward-facing wood or hybrid club head inserted through the central portal 20. The medium bristles 76 of the third zone 72 are disposed in the upper subassembly 70 for general cleaning of the front surfaces of regular, substantially flat-headed clubs that are inserted through the slot-like portals 30, 40 and the rear surfaces of woods or hybrid clubs that are inserted through the central portal 20.

As illustrated in FIG. 9, the bristles 98*a*, 98*b* of the fifth zone 92 are bristles of short length in comparison to the length of the long bristles of FIG. 7 and the medium bristles of FIG. 8. In the close-up view of FIG. 9, slight variations in lengths of the bristles 98*a*, 98*b* are denoted by "a" and "b" suffixes. The short bristles 98 of the fifth zone 92 are disposed in the upper subassembly 70 adjacent the slot-like portals 30, 40 for aggressive cleaning of the front surfaces of regular, substantially flat-headed clubs that are inserted through the slot-like portals 30, 40. Although all of the bristles 98 in a tuft 96 of the fifth bristle zone 92 may be of substantially uniform length, more effective cleaning may be obtained by using short bristles 98*a*, 98*b* of irregular lengths as illustrated. The irregularity in length enhances the cleaning action as club faces are rubbed across the tops of the bristles 98*a*, 98*b*.

The lower subassembly 50 and the upper subassembly 70 may be joined by conventional attachment means and mechanisms to form the housing and its components 12, 14, 16. The invention teaches joining the subassemblies at the posts 53, 73 by mechanisms such as application of adhesive or screws.

Figure 10:
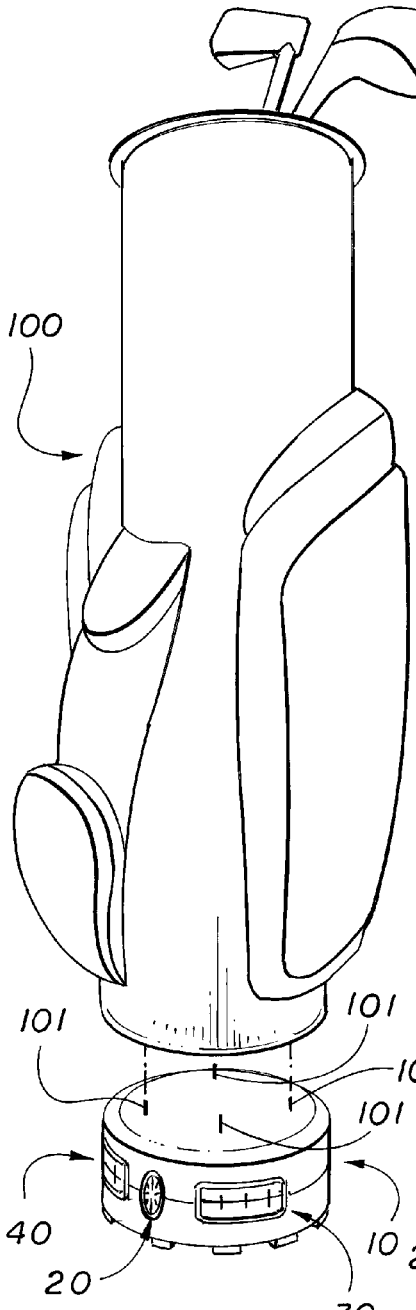
FIG. 10 is an illustration of the apparatus of FIG. 1 as attachable to a preexisting golf bag.

Referring now to FIG. 10, therein is illustrated an apparatus for cleaning the heads of club clubs 10 attached to a preexisting golf bag 100. The apparatus 10 may be attached to a golf bag by any suitable conventional fastening mechanisms and elements. As illustrated, screws 101 are suitable elements for attaching the apparatus 10 to a golf bag 100.

Figure 11:
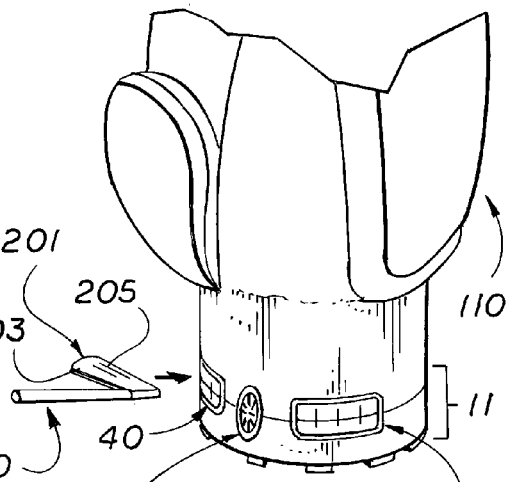
FIG. 11 is an illustration of an apparatus for storing, transporting and cleaning the heads of golf clubs in accordance with an embodiment of the invention.

Referring now to FIG. 11, the teachings of the invention are integrally incorporated into an apparatus for storing, transporting and cleaning the heads of golf clubs 110. The housing 11 taught by the invention is disposed in the lower region of the apparatus 110.

Figure 12:
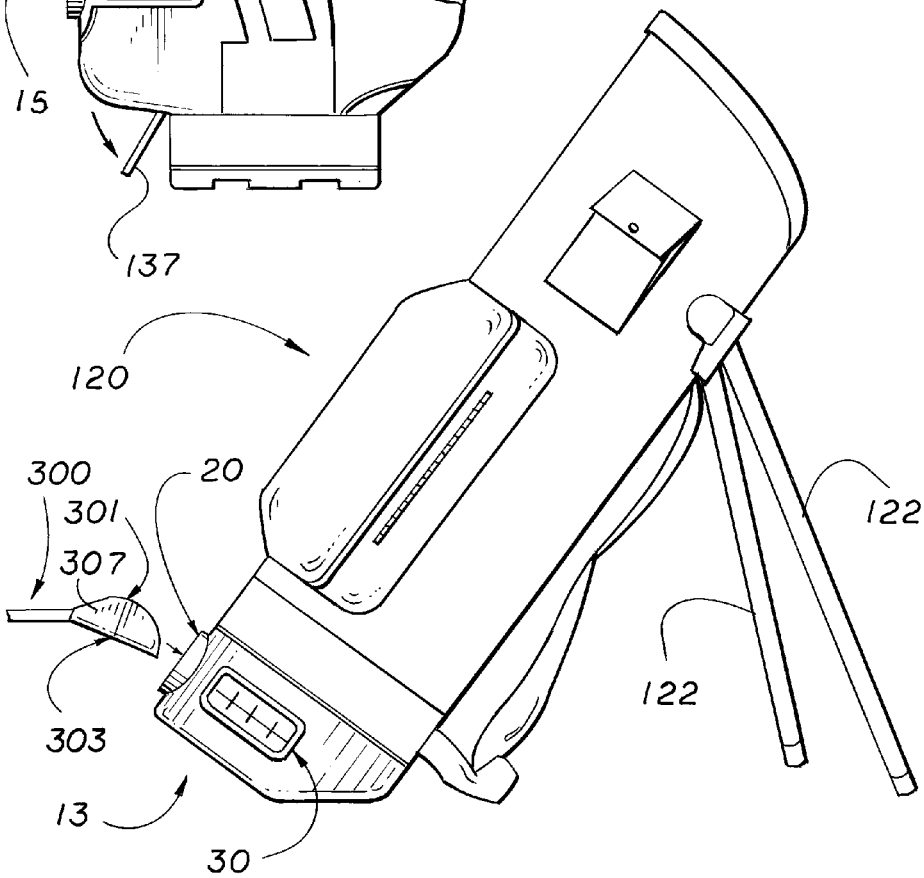
FIG. 12 is an illustration of an apparatus for cleaning the heads of golf clubs used with a stand-type golf bag in accordance with an embodiment of the invention.

Referring now to FIG. 12, an apparatus for cleaning the heads of golf clubs 13 is attached to or incorporated into the bottom of a golf bag 120 that has built-in legs 122 that form a stand. The housing of an apparatus for cleaning golf club heads 13 is truncated to accommodate the resting angle of the golf bag 120.

Figure 13:
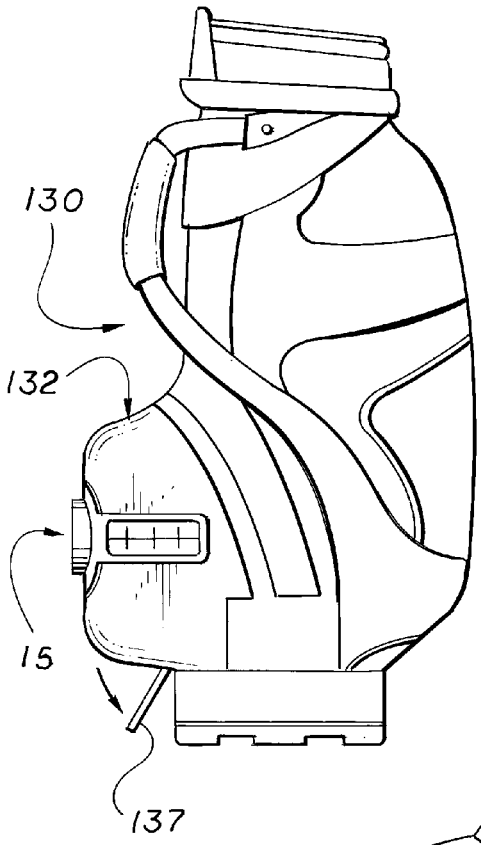
FIG. 13 is an illustration of an apparatus for cleaning the heads of golf clubs inserted in a ball and accessory compartment of a golf bag in accordance with an embodiment of the invention.

Referring now to FIG. 13, in another embodiment the housing of an apparatus for cleaning golf club heads 15 is incorporated into an upper or intermediate region of a golf bag 130 such as a golf-ball and accessory compartment 132, as shown. The golf bag 130 is shown in an upright resting condition from which the apparatus may be used, wherein the golf bag is supported at least in part by a retractable support member 137.

Referring now to FIG. 14, the apparatus for cleaning golf club heads 10 according to the housing embodiment of FIG. 1 is attached to a push or pull type golf cart 140 by conventional elements such as screws 141. A typical golf bag 142 may be secured upon the apparatus 10.

Referring now to FIG. 15, an apparatus for cleaning the heads of golf clubs 17 is incorporated into the bumper 152 of a riding golf cart 150.

The curtain flaps 32, 42 may be made from many different types of resilient, flexible material such as polypropylene or rubber sheeting.

The pads 54, 64, 74, 84, 94 for the brushes may be made from materials typically used as a base for brush bristles. For example, the pads may be fabricated from polypropylene molded resin. The brush bristles 58, 68, 78, 88, 98 may be made from natural or synthetic materials typically used to make brush bristles and tufts of brush bristles. For example, the tufts may be a collection of various fused synthetic polypropylene monofilaments. Other suitable materials are polyamides, polyesters, and polystyrenes. The filaments that comprise the bristles 58, 68, 78, 88, 98 may have many different diameters that provide the characteristics required that are described herein. For example, diameters may range from about 0.005 to about 0.05 inches. The bristles may have cross-sectional shapes that include a circular configuration. Examples of suitable brush bristle and tuft construction are shown in U.S. Pat. Nos. 5,597,212 and 5,511,274 to Lewis.

The opposing brush sets in the lower subassembly 50 and upper subassembly 70 define an opening therebetween for the insertion of golf club heads. The central-portal brush set 24 defines a central opening for the insertion of a golf club head. The width of the opening between the upper and lower brush sets and the diameter of the width of the opening of the central-portal brush set may vary. A suitable width ranges from about 0.001 to about 2.00 inches.

According to a methodology for cleaning the heads of golf clubs taught by the invention, a golf club head is inserted through a portal 20, 30, 40. Referring momentarily again to FIG. 11, the apparatus as taught by the invention is particularly suitable for use by inserting substantially flat club heads such as the heads of irons through one of the slot-like portals 30, 40. The head 201 of an iron-type golf club 200 is inserted with the head 203 facing upward into a slot-like opening. The club 202 shown is of the left-handed type. The club is oriented so that the groves 205 in the club face 203 and the club face 203 in general will contact (and thus be cleaned by) the fifth-zone 92 bristles 98 adjacent the portal and the third-zone 72 bristles 78. The rear surface (not shown) of the head 201 of the club 200 will contact (and thus be cleaned by) the first-zone 52 bristles 58. Referring now momentarily again to FIG. 12, the heads of wood or hybrid types of clubs are inserted through the central portal 20. The bulbous head 301 of a wood or hybrid type golf club 300 is inserted through the central portal 20 with the face 303 (generally identified but not fully visible) of the head 301 oriented downward. The face 303 of the club head 301 will engage (and thus be cleaned by) the second-zone 62 bristles 68. The rear surface 307 of the head 301 of the club 300 will contact (and thus be cleaned by) fourth-zone 82 brushes 88.

The curtains 22, 32, 42 serve to initially remove debris from club heads as they are inserted in the respective portals 20, 30, 40. The portal brush set 24 is disposed in the inner periphery of the central portal 20 for further effective general cleaning of the bulbous head of a wood or hybrid club as it is inserted through the central portal 20.

The apparatus may be used effectively from almost any orientation with respect to the ground. For example, the apparatus may be used when the apparatus is substantially horizontally disposed with respect to the ground as shown in FIG. 10, 11 or 15. The apparatus is also effectively used when the apparatus is oriented at an angle such as when used with a stand-type bag as shown in FIG. 12 or when used with a push or pull cart as shown in FIG. 14. The apparatus also may be used effectively if oriented perpendicularly with respect to the ground.

The invention may be practiced effectively when the apparatus is mounted to many different fixtures or articles. The apparatus is illustrated in the drawings and discussed herein as attached or attachable to the base of a golf bag as illustrated in FIGS. 10 and 12 and integrally formed with a golf bag, particularly at the lower end of the bag, as illustrated in FIG. 11. The apparatus may be affixed within mid-regions or upper regions of a golf bag such as in a pocket or pouch, as shown in FIG. 13.

In FIG. 15, the invention is shown (as is described herein) as being incorporated into the bumper region 152 of a riding golf cart 150. However, the invention also may be effectively used when mounted within any surface that has sufficient open space behind to accommodate the apparatus housing. Thus the invention may be incorporated into various regions of a golf bag as previously described or within various regions of a riding golf cart including a fender or a bumper previously described.

The invention also may be practiced effectively if the bristle-zone configuration of the lower and upper subassembly brush sets are reversed. Such a reversal would simply mean that the direction in which the faces of the club heads are oriented, as described above, would be reversed using the methodology of club-head cleaning as taught by the invention.

The invention provides a means that is convenient and effective for cleaning the head of a golf club, and particularly for cleaning the face of the head of a golf club. The apparatus taught by the invention provides effective dry cleaning, that is, it is not necessary to use a cleaning solution of any sort to clean the club. The apparatus is convenient because it can be attached to or incorporated into standard equipment such as a golf bag or golf cart. Thus the apparatus is available for use immediately after a golfer hits a shot by which the club head becomes soiled. Soon after a shot is completed, the golfer will return the club to the location where he has stored his or her clubs for further use or transport. That location is typically a golf bag either standing alone or placed upon a cart of some sort. Because the apparatus is at the point for returning the club, the club head of the club that has just been used can be inserted into the apparatus and the head can be cleaned immediately through the cleaning methodology described herein. Any most debris that has been deposited upon the club head will not have an opportunity to dry when the club can be cleaned immediately; therefore, dry and most debris are quickly and effectively removed. Once the head of the golf club is clean, the golfer is ready to move to the location on the golf course.

Many variations and modifications may be made to the above-described embodiments without departing from the scope of the claims. All such modifications, combinations, and variations are included herein by the scope of this disclosure and the following claims.

The invention claimed is:

1. An apparatus for cleaning heads of golf clubs, the apparatus comprising:

a substantially upstanding housing defining a chamber, said housing having an upper end terminating in a closed top wall, a lower end terminating in a closed bottom wall, a side wall structure interconnecting said upper end and said lower end, and at least one portal through said side wall structure for insertion of a golf club head;

a first set of brushes extending into said chamber from said closed top wall; and a second set of brushes extending into said chamber from said closed bottom wall;

wherein terminal ends of said first set of brushes and said second set of brushes define a substantially narrow passageway substantially parallel to said closed top wall and said closed bottom wall in alignment with said at least one portal.

2. The apparatus of claim 1, wherein at least one of said first set of brushes and said second set of brushes comprises a plurality of bristle regions wherein each bristle region has brush bristles of a predetermined length and a predetermined rigidity and wherein at least one of said predetermined length and said predetermined rigidity of said brush bristles of one region are different than those of said brush bristles of another region.

3. The apparatus of claim 1, wherein at least one of said at least one portal has a plurality of portal brush bristles extending inwardly from a periphery thereof terminating in a portal brush opening.

4. The apparatus of claim 1, wherein said at least one portal has at least one flexible but resilient flap covering said portal.

5. The apparatus of claim 4, wherein said at least one flexible but resilient flap comprises opposing ones of said flexible but resilient flaps extending from a periphery of said portal.

6. The apparatus of claim 1, wherein at least one of said at least one portal has a substantially curvilinear configuration.

7. The apparatus of claim 6, wherein said substantially curvilinear configuration is substantially elliptical.

8. The apparatus of claim 6, wherein said substantially curvilinear configuration is substantially circular.

9. The apparatus of claim 1, wherein at least one of said at least one portal has a substantially curvilinear configuration and has portal brush bristles extending inwardly from an inner periphery thereof terminating in a portal brush opening concentric to and representative of said substantially curvilinear configuration.

10. The apparatus of claim 1, wherein said at least one portal comprises a substantially curvilinear portal and at least one flanking substantially slot-like portal.

11. The apparatus of claim 10, wherein said first set of brushes comprises:

a first bristle zone having first brush bristles of a first length and rigidity disposed substantially throughout said interior of said lower end of said housing, a second bristle zone having second brush bristles of a second length and rigidity disposed adjacent said substantially curvilinear portal, a third bristle zone having third brush bristles of a third length and rigidity disposed substantially throughout said interior of said upper end of said housing, a fourth bristle zone having fourth brush bristles of a fourth length and rigidity disposed adjacent said substantially curvilinear portal, and a fifth bristle zone having fifth brush bristles of a fifth length and rigidity disposed adjacent said at least one flanking substantially slot-like portal.

12. The apparatus of claim 1, wherein said housing is formed of a lower subassembly and an upper subassembly.

13. The apparatus of claim 1, wherein said housing is substantially cylindrical.

14. The apparatus of claim 1, further comprising at least one aperture for removal of debris disposed in said closed bottom wall of said lower end of said housing.

15. The apparatus of claim 14, wherein said at least one aperture is disposed proximate a periphery of said housing.

16. An apparatus for storing, transporting and cleaning heads of golf clubs, the apparatus comprising:

a substantially upstanding elongated container having a first substantially open upper end for receiving shafts of golf clubs;

a substantially upstanding housing integrally formed with and in alignment with said elongated container, said housing defining a chamber said housing having an upper end terminating in a closed top wall, a lower end terminating in a closed bottom wall, a side wall structure interconnecting said upper end and said lower end, and at least one portal through said side wall structure for insertion of a golf club head;

a first set of brushes extending into said chamber from said closed top wall; and a second set of brushes extending into said chamber from said closed bottom wall;

wherein terminal ends of said first set of brushes and said second set of brushes define a substantially narrow passageway substantially parallel to said closed top wall and said closed bottom wall in alignment with said at least one portal.

17. The apparatus of claim 16, wherein said housing is disposed at a lower region of said elongated container.

18. The apparatus of claim 16, wherein said housing is disposed intermediate said upper end and a lower region of said upstanding elongated container.

19. A method for cleaning a head of a golf club, the method comprising:

providing a substantially upstanding housing defining a chamber said housing having an upper end terminating in a closed top wall, a lower end terminating in a closed bottom wall, a side wall structure interconnecting said upper end and said lower end, and at least one portal through said side wall structure for insertion of a golf club head;

a first set of brushes extending into said chamber from said closed top wall; and a second set of brushes extending into said chamber from said closed bottom wall;

wherein terminal ends of said first set of brushes and said second set of brushes define a substantially narrow passageway substantially parallel to said closed top wall and said closed bottom wall in alignment with said at least one portal; and inserting the head of a golf club through one of said at least one portal and drawing a face of the golf club at least once across at least a portion of at least one said first set of brushes and second set of brushes that lie adjacent said one of said at least one portal.

20. The method of claim 19, wherein the step of providing a substantially upstanding housing further comprises the step of affixing said substantially upstanding housing with respect to an apparatus for storing and transporting golf clubs.

* * * * *